US011837154B2

(12) United States Patent
Lu

(10) Patent No.: US 11,837,154 B2
(45) Date of Patent: Dec. 5, 2023

(54) DRIVING DEVICE AND OPERATION METHOD THEREOF AND DISPLAY APPARATUS

(71) Applicant: Novatek Microelectronics Corp., Hsinchu (TW)

(72) Inventor: Yu-Tsung Lu, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/723,480

(22) Filed: Apr. 19, 2022

(65) Prior Publication Data

US 2023/0335042 A1 Oct. 19, 2023

(51) Int. Cl.

| | |
|---|---|
| ***G09G 3/32*** | (2016.01) |
| ***G09G 3/3233*** | (2016.01) |
| ***G09G 3/3258*** | (2016.01) |

(52) U.S. Cl.

CPC ..... *G09G 3/32* (2013.01); *G09G 3/3233* (2013.01); *G09G 3/3258* (2013.01); *G09G 2310/027* (2013.01); *G09G 2310/08* (2013.01)

(58) Field of Classification Search

CPC ..... G09G 3/32; G09G 3/3233; G09G 3/325; G09G 3/3258; G09G 3/3291; G09G 2310/027; G09G 2310/08

See application file for complete search history.

(56) References Cited

U.S. PATENT DOCUMENTS

| | | | | |
|---|---|---|---|---|
| 7,315,313 | B2 * | 1/2008 | Nose | G09G 3/3611 345/88 |
| 9,324,285 | B2 * | 4/2016 | Furihata | G09G 3/3648 |
| 11,594,162 | B2 * | 2/2023 | Li | G09G 3/36 |
| 2008/0088560 | A1 | 4/2008 | Bae et al. | |
| 2008/0316232 | A1 | 12/2008 | Ryu et al. | |
| 2010/0117935 | A1 | 5/2010 | Seo et al. | |
| 2013/0155124 | A1 * | 6/2013 | Tsuge | G09G 3/3233 345/690 |
| 2022/0076610 | A1 | 3/2022 | Pappas et al. | |

OTHER PUBLICATIONS

"Office Action of Taiwan Counterpart Application", dated Jun. 26, 2023, p. 1-p. 11.

* cited by examiner

*Primary Examiner* — Vijay Shankar

(74) *Attorney, Agent, or Firm* — JCIPRNET

(57) ABSTRACT

A driving device, an operation method thereof, and a display apparatus are disclosed. The driving device is configured to drive a display panel. The driving device divides an image frame period into a plurality of sub-frame periods. A target pixel circuit in the display panel corresponds to target pixel data comprising at least one bit. Each bit in the target pixel data corresponds to at least one corresponding sub-frame period among the sub-frame periods. Different bits in the target pixel data correspond to different sub-frame periods among the sub-frame periods. According to a current bit in the target pixel data, the driving device determines whether to light up the target pixel circuit during the at least one corresponding sub-frame period corresponding to the current bit.

21 Claims, 7 Drawing Sheets

DRIVING DEVICE AND OPERATION METHOD THEREOF AND DISPLAY APPARATUS

BACKGROUND

Technical Field

The disclosure relates to an electronic device. In particular, the disclosure relates to a driving device and an operation method thereof, and a display apparatus.

Description of Related Art

FIG. 1 is a schematic diagram of driving timing of a display panel. The horizontal axis shown in FIG. 1 represents time. A vertical synchronization signal V-sync may define an image frame period, for example, an image frame period FRAME1 shown in FIG. 1. The image frame period FRAME1 includes a plurality of scan line periods L1, L2, L3, . . . , LN. The scan line periods L1 to LN may be defined by a horizontal synchronization signal H-sync. A data driving circuit (not shown) may convert a grayscale data stream D<i> corresponding to a data line (for example, an i-th data line, not shown) of the display panel into a pulse-width modulation (PWM) signal stream DL<i>, and then transmit the PWM signal stream DL<i> through the i-th data line to different pixel circuits (not shown) of the display panel. For example, the data driving circuit may convert a grayscale data D1 into a PWM signal PWM1, and then transmits the PWM signal PWM1 through the i-th data line to a first pixel circuit P<i,1> (a circuit not shown) connected to the i-th data line. Similarly, the data driving circuit may convert grayscale data D2, D3, . . . , DN into PWM signals PWM2, PWM3, . . . , PWMN, and then transmit the PWM signals PWM2 to PWMN at different times through the i-th data line to a second pixel circuit P<i,2>, a third pixel circuit P<i,3>, . . . , and an N-th pixel circuit P<i,N> connected to the i-th data line.

During the scan line period L1, since the first pixel circuit P<i,1> connected to the i-th data line is turned on, the PWM signal PWM1 may be transmitted to the inside of the first pixel circuit P<i,1> (a circuit not shown). During the period when the PWM signal PWM1 is at a high level, the first pixel circuit P<i,1> is lit up (labeled as "ON" in FIG. 1). During the period when the PWM signal PWM1 is at a low level, the first pixel circuit P<i,1> is unlit (labeled as "OFF" in FIG. 1). After the scan line period L1 ends, the first pixel circuit P<i,1> connected to the i-th data line is turned off, and the first pixel circuit P<i,1> remains unlit until the next image frame period (not shown). Similarly, during the scan line period L2, since the second pixel circuit P<i,2> connected to the i-th data line is turned on, the PWM signal PWM2 may be transmitted to the inside of the second pixel circuit P<i,2> (a circuit not shown).

The driving timing shown in FIG. 1 faces some issues. For example, one of the issues is a great peak current Ip (instantaneous maximum brightness) of the PWM signal stream DL<i>. During the entire image frame period FRAME1, since the pixel circuit P<i,1> is lit up during only part of the scan line period L1, the instantaneous maximum brightness of the pixel circuit P<i,1> is averaged by the human eye over the entire image frame period FRAME1. In order to make the human eye perceive that the average brightness of the pixel circuit P<i,1> over the entire image frame period FRAME1 matches a certain target brightness, it is required to pull up the peak current Ip (instantaneous maximum brightness) of the PWM signal stream DL<i>.

Another issue with the driving timing shown in FIG. 1 is PWM duty resolution. Taking a display panel with 1,000 scan lines (one image frame period including 1,000 scan line periods) as an example, assuming that the refresh rate is 100 Hz, and not considering any timing margin, then the duration of each scan line period is 10 ms/1000=10 us. If the PWM duty resolution adopts a 8-bit resolution, the minimum clock period should be 10 us/256≈40 ns, that is, the minimum frequency of the oscillation circuit is 50 MHz. If the PWM duty resolution adopts a higher resolution, for example, a 12-bit resolution, the minimum clock period should be 10 us/4096≈2.4 ns, that is, the minimum frequency of the oscillation circuit is 400 MHz. The requirements for realizing such a high-frequency oscillation circuit may be considerable.

It should be noted that the contents of the section of "Description of Related Art" is used for facilitating the understanding of the disclosure. Part of the contents (or all of the contents) disclosed in the section of "Description of Related Art" may not pertain to the conventional technology known to persons with ordinary skilled in the art. The contents disclosed in the section of "Description of Related Art" do not mean to have been known to persons with ordinary skilled in the art prior to the time of filing this application.

SUMMARY

The disclosure provides a display apparatus, and a driving device and an operation method thereof to drive a display panel.

In an embodiment of the disclosure, the driving device includes a data driving circuit and a timing control circuit. The data driving circuit is configured to be coupled to the display panel. The timing control circuit is coupled to the data driving circuit. The timing control circuit is configured to divide an image frame period into a plurality of sub-frame periods. A target pixel circuit in the display panel corresponds to target pixel data including at least one bit. Each bit in the target pixel data corresponds to at least one corresponding sub-frame period among the plurality of sub-frame periods. Different bits in the target pixel data correspond to different sub-frame periods among the plurality of sub-frame periods. According to a current bit in the target pixel data, the timing control circuit determines whether to light up the target pixel circuit through the data driving circuit during the at least one corresponding sub-frame period corresponding to the current bit.

In an embodiment of the disclosure, the operation method includes the following. An image frame period is divided into a plurality of sub-frame periods. The driving device is configured to drive a display panel. A target pixel circuit in the display panel corresponds to target pixel data including at least one bit. Each bit in the target pixel data corresponds to at least one corresponding sub-frame period among the plurality of sub-frame periods. Different bits in the target pixel data correspond to different sub-frame periods among the plurality of sub-frame periods. According to a current bit in the target pixel data, it is determined whether to light up the target pixel circuit during the at least one corresponding sub-frame period corresponding to the current bit.

In an embodiment of the disclosure, the display apparatus includes a display panel and a driving device. The driving device is coupled to the display panel and configured to drive the display panel. The driving device divides an image frame period into a plurality of sub-frame periods. A target pixel circuit in the display panel corresponds to target pixel data including at least one bit. Each bit in the target pixel data corresponds to at least one corresponding sub-frame period among the plurality of sub-frame periods. Different bits in the target pixel data correspond to different sub-frame periods among the plurality of sub-frame periods. According to a current bit in the target pixel data, the driving device determines whether to light up the target pixel circuit during the at least one corresponding sub-frame period corresponding to the current bit.

Based on the foregoing, the driving device according to the embodiments of the disclosure may divide an image frame period into a plurality of sub-frame periods. Different bits in the same pixel data correspond to different sub-frame periods. According to the current bit in the pixel data of the target pixel circuit, the driving device may determine whether to light up the target pixel circuit during the sub-frame period corresponding to the current bit.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
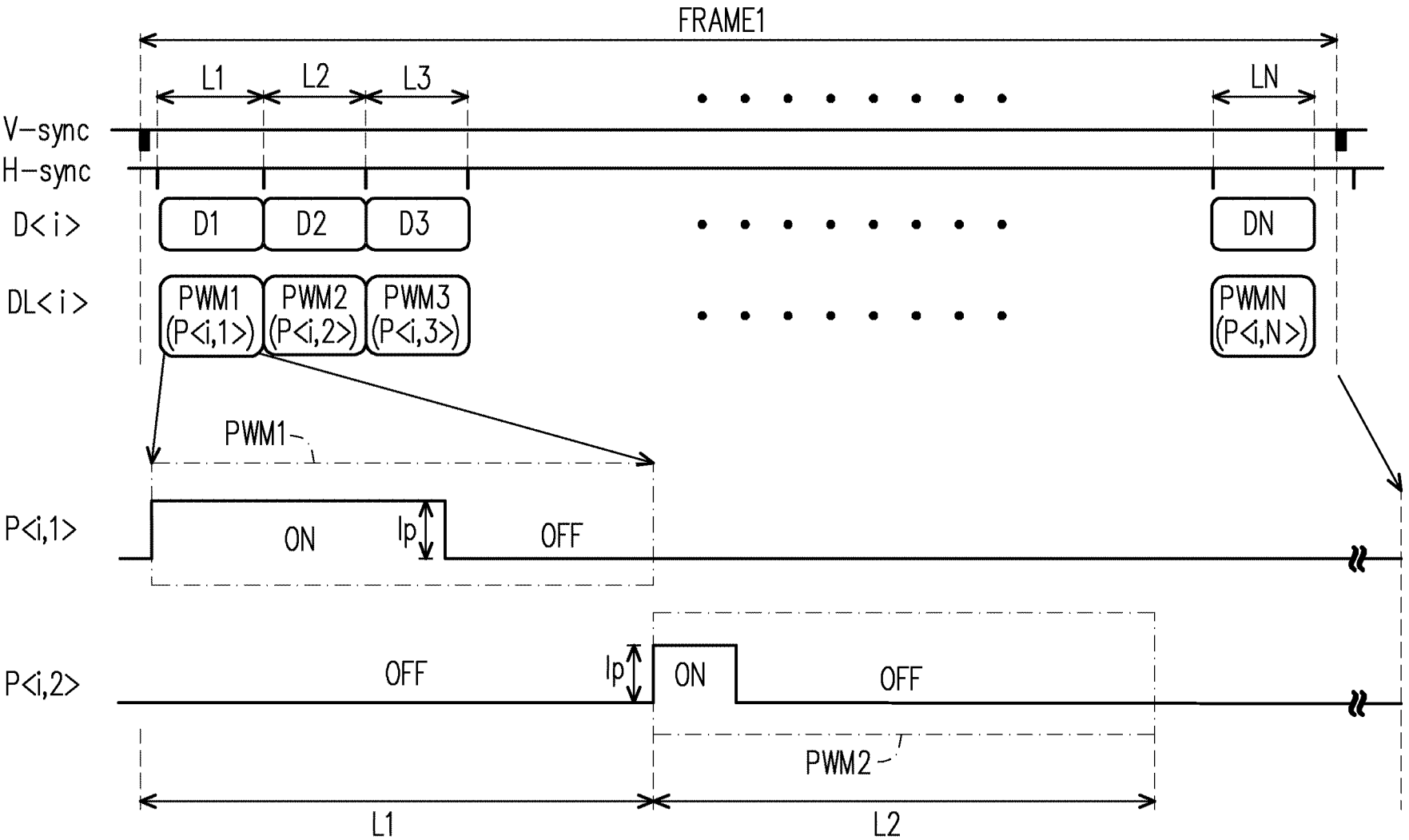
FIG. 1 (PRIOR ART)
FIG. 1 is a schematic diagram of driving timing of a display panel.

The term "coupling (or connection)" as used throughout this specification (including the claims) may refer to any direct or indirect means of connection. For example, if it is herein described that a first device is coupled (or connected) to a second device, it should be interpreted that the first device may be directly connected to the second device, or the first device may be indirectly connected to the second device through other devices or some connection means. Terms such as "first" and "second" mentioned throughout the description (including the claims) are used to name elements, or to distinguish between different embodiments or scopes, and are not used to limit the upper or lower bound of the number of elements, nor used to limit the sequence of elements. In addition, wherever possible, elements/members/steps using the same reference numerals in the drawings and embodiments denote the same or similar parts. Cross-reference may be made to relevant descriptions of elements/members/steps using the same reference numerals or using the same terms in different embodiments.

Figure 2:
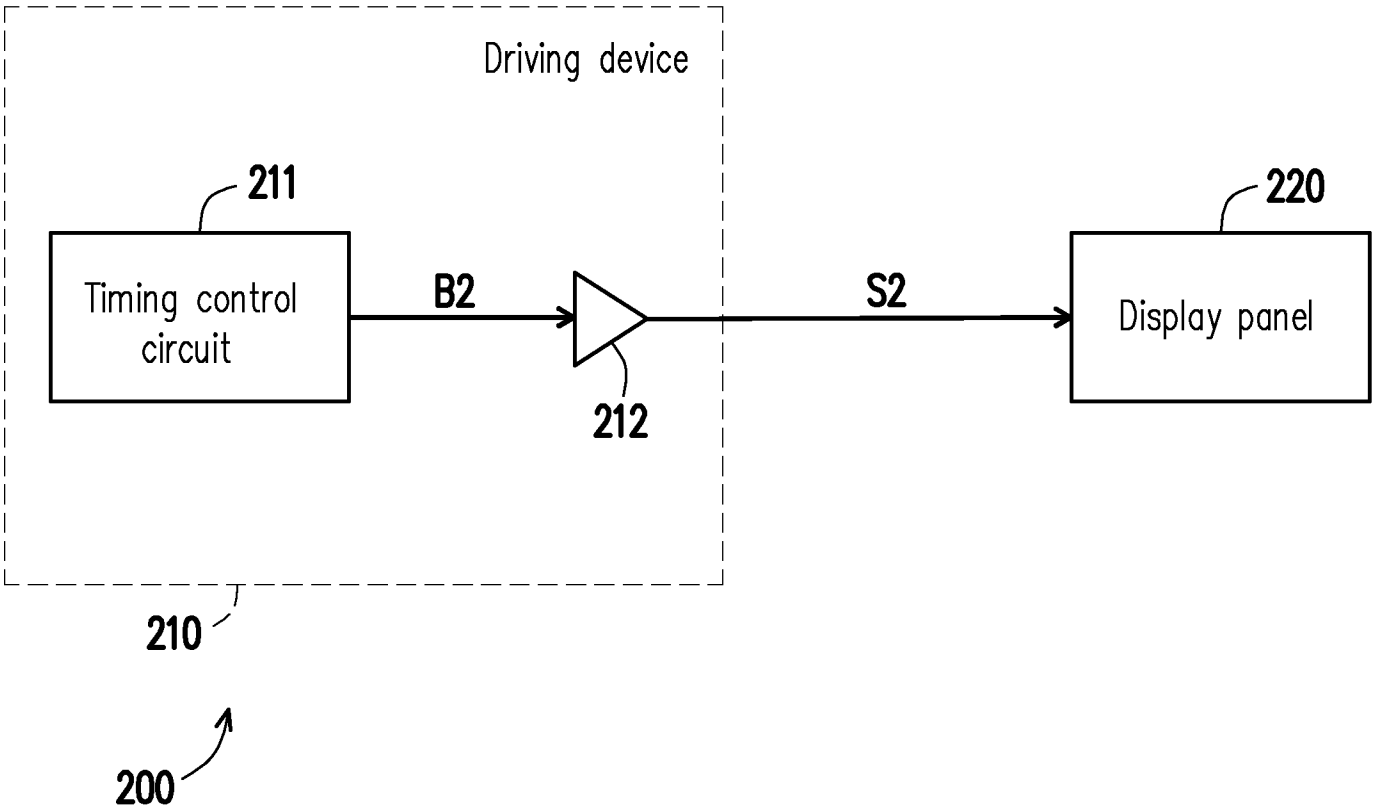
FIG. 2 is a circuit block diagram of a display apparatus according to an embodiment of the disclosure.

FIG. 2 is a circuit block diagram of a display apparatus 200 according to an embodiment of the disclosure. The display apparatus 200 shown in FIG. 2 includes a driving device 210 and a display panel 220. The driving device 210 is coupled to the display panel 220 and configured to drive the display panel 220. The display panel 220 includes a pixel array (not shown) having a plurality of pixel circuits. The driving device 210 may divide an image frame period into a plurality of sub-frame periods. A target pixel circuit (not shown) in the display panel 220 corresponds to target pixel data of the image frame period which include at least one bit. Each bit in the target pixel data corresponds to at least one corresponding sub-frame period among the sub-frame periods, and different bits in the target pixel data correspond to different sub-frame periods. According to a current bit in the target pixel data, the driving device 210 may determine whether to light up the target pixel circuit during the corresponding sub-frame period corresponding to the current bit.

In the embodiment shown in FIG. 2, the driving device 210 includes a timing control circuit 211 and a data driving circuit 212. An output terminal of the data driving circuit 212 may be coupled to a data line (not shown) of the display panel 220. An output terminal of the timing control circuit 211 is coupled to an input terminal of the data driving circuit 212. Depending on different design requirements, the driving device 210 and/or the timing control circuit 211 may be realized in a form of hardware, firmware, software (i.e., programs), or a combination of multiple of the above three.

In terms of hardware form, the driving device 210 and/or the timing control circuit 211 may be realized as a logic circuit on an integrated circuit. The relevant functions of the driving device 210 and/or the timing control circuit 211 may be realized as hardware utilizing a hardware description language (e.g., Verilog HDL or VHDL) or other suitable programming languages. For example, the relevant functions of the driving device 210 and/or the timing control circuit 211 may be realized as various logic blocks, modules, and circuits in one or more controllers, microcontrollers, microprocessors, application-specific integrated circuits (ASICs), digital signal processors (DSPs), field programmable gate arrays (FPGAs), and/or other processing units.

In terms of software form and/or firmware form, the relevant functions of the driving device 210 and/or the timing control circuit 211 may be realized as programming codes. For example, the driving device 210 and/or the timing control circuit 211 may be realized by utilizing a general programming language (e.g., C, C++, or assembly language) or other suitable programming languages. The programming codes may be recorded/stored in a "non-transitory computer readable medium". In some embodiments, the non-transitory computer readable medium includes, for example, semiconductor memory, programmable logic circuits, and/or storage devices. A central processing unit (CPU), controller, microcontroller, or microprocessor may read and execute the programming codes from the non-transitory computer readable medium and thereby realize the relevant functions of the driving device 210 and/or the timing control circuit 211.

Figure 3:
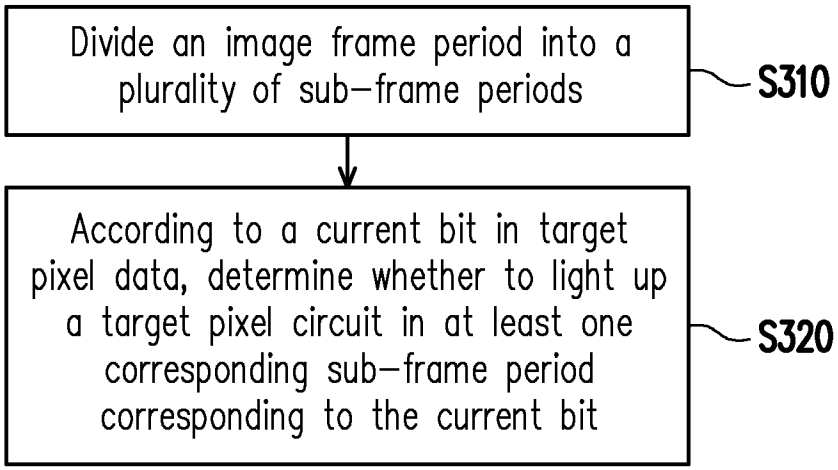
FIG. 3 is a schematic flowchart of an operation method of a driving device according to an embodiment of the disclosure.

FIG. 3 is a schematic flowchart of an operation method of a driving device 210 according to an embodiment of the disclosure. Please refer to FIG. 2 and FIG. 3. In step S310, the timing control circuit 211 may divide an image frame period into a plurality of sub-frame periods. In step S320, according to a current bit in target pixel data corresponding to a target pixel circuit (not shown) in the display panel 220, the timing control circuit 211 may determine whether to light up the target pixel circuit through the data driving circuit 212 during at least one sub-frame period (a corresponding sub-frame period) corresponding to the current bit. The timing control circuit 211 may output different bits in target pixel data corresponding to a target pixel circuit in the display panel 220 to the data driving circuit 212 during different sub-frame periods.

For example, the timing control circuit 211 may output a bit (e.g., a current bit B2) in the target pixel data to the data driving circuit 212 during the current sub-frame period. The data driving circuit 212 may convert the current bit B2 provided by the timing control circuit 211 into a switch signal S2, and then output the switch signal S2 to the target pixel circuit (not shown) during the current sub-frame period. When the current bit B2 is in a first logic state, the timing control circuit 211 may determine to light up the target pixel circuit during at least one corresponding sub-frame period corresponding to the current bit B2. After the target pixel circuit is lit up, the target pixel circuit remains lit up over the current sub-frame period until the next sub-frame period. When the current bit B2 is in a second logic state, the timing control circuit 211 may determine not to light up the target pixel circuit during the at least one corresponding sub-frame period corresponding to the current bit B2. After the target pixel circuit is determined not to be lit up, the target pixel circuit remains unlit over the current sub-frame period until the next sub-frame period.

Figure 4:
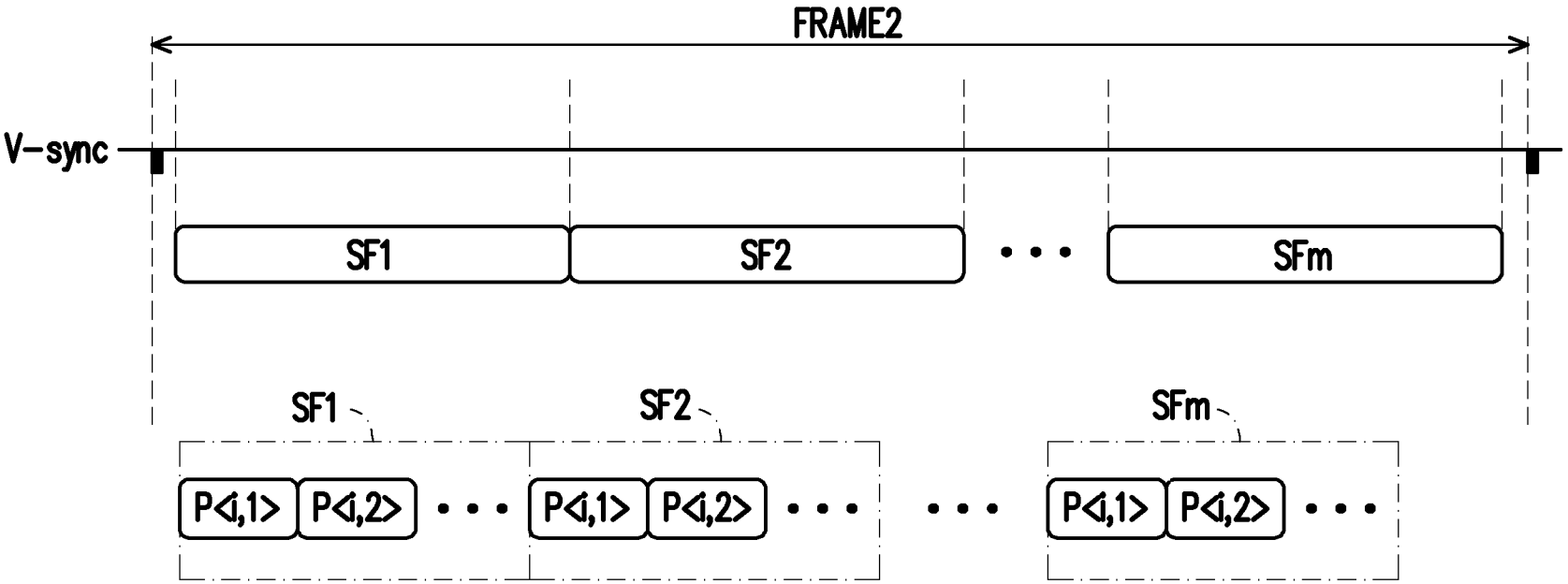
FIG. 4 is a schematic diagram of driving timing of a display panel according to an embodiment of the disclosure.

FIG. 4 is a schematic diagram of driving timing of a display panel according to an embodiment of the disclosure. The horizontal axis shown in FIG. 4 represents time. The vertical synchronization signal V-sync may define an image frame period, for example, an image frame period FRAME2 shown in FIG. 4. The timing control circuit 211 may divide the image frame period FRAME2 into a plurality of sub-frame periods, for example, sub-frame periods SF1, SF2, . . . , SFm shown in FIG. 4. During each of the sub-frame periods SF1 to SFm, the timing control circuit 211 may scan all scan lines (not shown) of the display panel 220. For example, it is assumed that an i-th data line (not shown) of the display panel 220 is connected to a plurality of pixel circuits P<i,1>, P<i,2>, . . . (circuits not shown). The timing control circuit 211 may scan all the pixel circuits P<i,1>, P<i,2>, . . . connected to the i-th data line during the sub-frame period SF1 During the sub-frame period SF2, the timing control circuit 211 may again scan all the pixel circuits P<i,1>, P<i,2>, . . . connected to the i-th data line. By analogy, during the sub-frame period SFm, the timing control circuit 211 may yet again scan all the pixel circuits P<i,1>, P<i,2>, . . . connected to the i-th data line.

Here, pixel data corresponding to a target pixel circuit (not shown) in the display panel 220 is referred to as target pixel data including at least one bit. Each bit in target pixel data corresponds to at least one corresponding sub-frame period among the sub-frame periods SF1 to SFm, and different bits in the target pixel data correspond to different sub-frame periods among the sub-frame periods SF1 to SFm. Time lengths of the sub-frame periods SF1 to SFm shown in FIG. 4 may be defined depending on the actual design. For example, in some embodiments, the time lengths of the sub-frame periods SF1 to SFm may be equal to each other, and a total time length of the at least one corresponding sub-frame period corresponding to the current bit in the target pixel data corresponds to a bit position of the current bit. If the target pixel data is [b3, b2, b1, b0] (where b3, b2, b1, and b0 represent different bits in the target pixel data), then the bit b0 corresponds to one corresponding sub-frame period among the sub-frame periods SF1 to SFm, the bit b1 corresponds to two corresponding sub-frame periods among the sub-frame periods SF1 to SFm, the bit b2 corresponds to four corresponding sub-frame periods among the sub-frame periods SF1 to SFm, and the bit b3 corresponds to eight corresponding sub-frame periods among the sub-frame periods SF1 to SFm.

Figure 5:
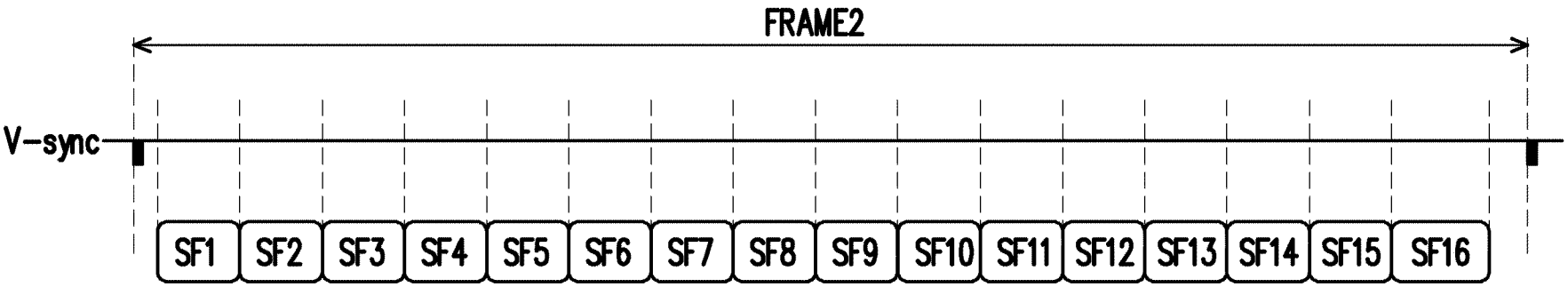
FIG. 5 is a schematic diagram of dividing an image frame period according to an embodiment of the disclosure.

FIG. 5 is a schematic diagram of dividing an image frame period FRAME2 according to an embodiment of the disclosure. The horizontal axis shown in FIG. 5 represents time. In the embodiment shown in FIG. 5, the image frame period FRAME2 is divided into 16 sub-frame periods SF1 to SF16. For the vertical synchronization signal V-sync, the image frame period FRAME2, and the sub-frame periods SF1 to SF16 shown in FIG. 5, reference may be made to the relevant descriptions of the vertical synchronization signal V-sync, the image frame period FRAME2, and the sub-frame periods SF1 to SFm shown in FIG. 4, which will not be repeated here. The sub-frame period SF16 may be configured for clearing data in the target pixel circuit (not shown). In the embodiment shown in FIG. 5, the time lengths of the sub-frame periods SF1 to SF15 may be equal to each other. If the target pixel data is [b3, b2, b1, b0], then the bit b0 corresponds to one corresponding sub-frame period among the sub-frame periods SF1 to SF15, the bit b1 corresponds to two corresponding sub-frame periods among the sub-frame periods SF1 to SF15, the bit b2 corresponds to four corresponding sub-frame periods among the sub-frame periods SF1 to SF15, and the bit b3 corresponds to eight corresponding sub-frame periods among the sub-frame periods SF1 to SF15.

For example, in the target pixel data [b3, b2, b1, b0] in some embodiments, the bit b0 may correspond to the sub-frame period SF15, the bit b1 may correspond to the sub-frame periods SF13 and SF14, the bit b2 may correspond to the sub-frame periods SF9 to SF12, and the bit b3 may correspond to the sub-frame periods SF1 to SF8. In some other embodiments, the bit b0 may correspond to the sub-frame period SF11, the bit b1 may correspond to the sub-frame periods SF7 and SF12, the bit b2 may correspond to the sub-frame periods SF2, SF5, SF9, and SF14, and the bit b3 may correspond to the sub-frame periods SF1, SF3, SF4, SF6, SF8, SF10, SF13, and SF15. In other embodiments, the target pixel data [b3, b2, b1, b0] may have other correspondences with the sub-frame periods SF1 to SF15.

In some other embodiments, the time lengths of the sub-frame periods SF1 to SFm shown in FIG. 4 may be not equal to each other, and the time length of each of the sub-frame periods SF1 to SFm corresponds to a bit position of a corresponding bit in the target pixel data. For example, it is assumed that the image frame period FRAME2 is divided into four sub-frame periods SF1, SF2, SF3, and SF4. Depending on the actual design, the time length of the sub-frame period SF3 may be twice the time length of the sub-frame period SF4, the time length of the sub-frame period SF2 may be four times the time length of the sub-frame period SF4, and the time length of the sub-frame period SF1 may be eight times the time length of the sub-frame period SF4. If the target pixel data is [b3, b2, b1, b0], then the bit b0 corresponds to the sub-frame period SF4, the bit b1 corresponds to the sub-frame period SF3, the bit b2 corresponds to the sub-frame period SF2, and the bit b3 corresponds to the sub-frame period SF1.

Figure 6:
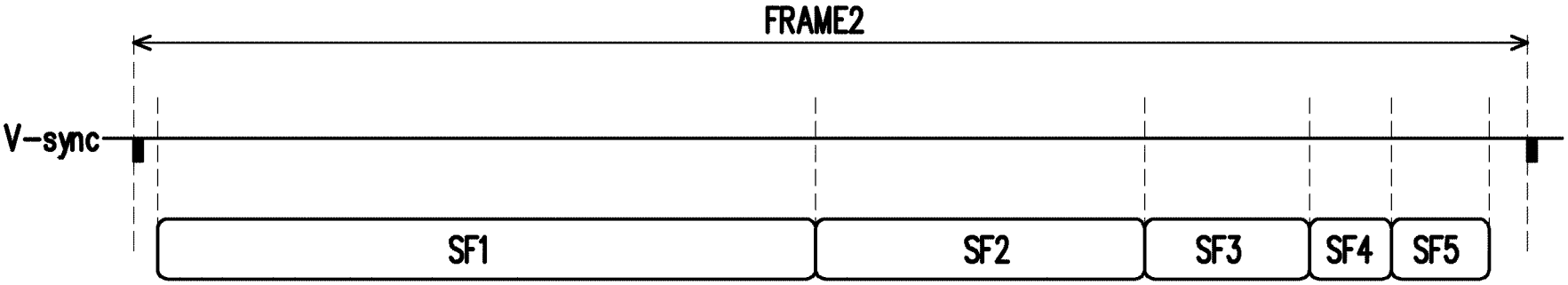
FIG. 6 is a schematic diagram of dividing an image frame period according to another embodiment of the disclosure.

For example, FIG. 6 is a schematic diagram of dividing the image frame period FRAME2 according to another embodiment of the disclosure. The horizontal axis shown in FIG. 6 represents time. In the embodiment shown in FIG. 6, the image frame period FRAME2 is divided into five sub-frame periods SF1, SF2, SF3, SF4, and SF5. For the vertical synchronization signal V-sync, the image frame period FRAME2, and the sub-frame periods SF1 to SF5 shown in FIG. 6, reference may be made to the relevant descriptions of the vertical synchronization signal V-sync, the image frame period FRAME2, and the sub-frame periods SF1 to SFm shown in FIG. 4, which will not be repeated here. The sub-frame period SF5 may be configured for clearing data in the target pixel circuit (not shown). In the embodiment shown in FIG. 6, the time lengths of the sub-frame periods SF1 to SF4 may be not equal to each other, and the time length of each of the sub-frame periods SF1 to SF4 corresponds to a bit position of a corresponding bit in the target pixel data [b3, b2, b1, b0]. The time length of the sub-frame period SF3 shown in FIG. 6 may be twice the time length of the sub-frame period SF4, the time length of the sub-frame period SF2 may be four times the time length of the sub-frame period SF4, and the time length of the sub-frame period SF1 may be eight times the time length of the sub-frame period SF4. In the target pixel data [b3, b2, b1, b0], the bit b0 corresponds to the sub-frame period SF4, the bit b1 corresponds to the sub-frame period SF3, the bit b2 corresponds to the sub-frame period SF2, and the bit b3 corresponds to the sub-frame period SF1.

According to a current bit in the target pixel data corresponding to a target pixel circuit (not shown) in the display panel 220, the timing control circuit 211 may determine whether to light up the target pixel circuit through the data driving circuit 212 during the sub-frame period (the corresponding sub-frame period) corresponding to the current bit. It is assumed that the target pixel data of the target pixel circuit (not shown) is [1, 0, 0, 0]. According to a current bit "1" in the target pixel data [1, 0, 0, 0], the timing control circuit 211 may determine to light up the target pixel circuit through the data driving circuit 212 during the corresponding sub-frame period SF1 of the current bit "1". By analogy, the timing control circuit 211 may determine not to light up the target pixel circuit during the corresponding sub-frame periods SF2, SF3, and SF4 of the following bits "0", "0", and "0".

Figure 7:
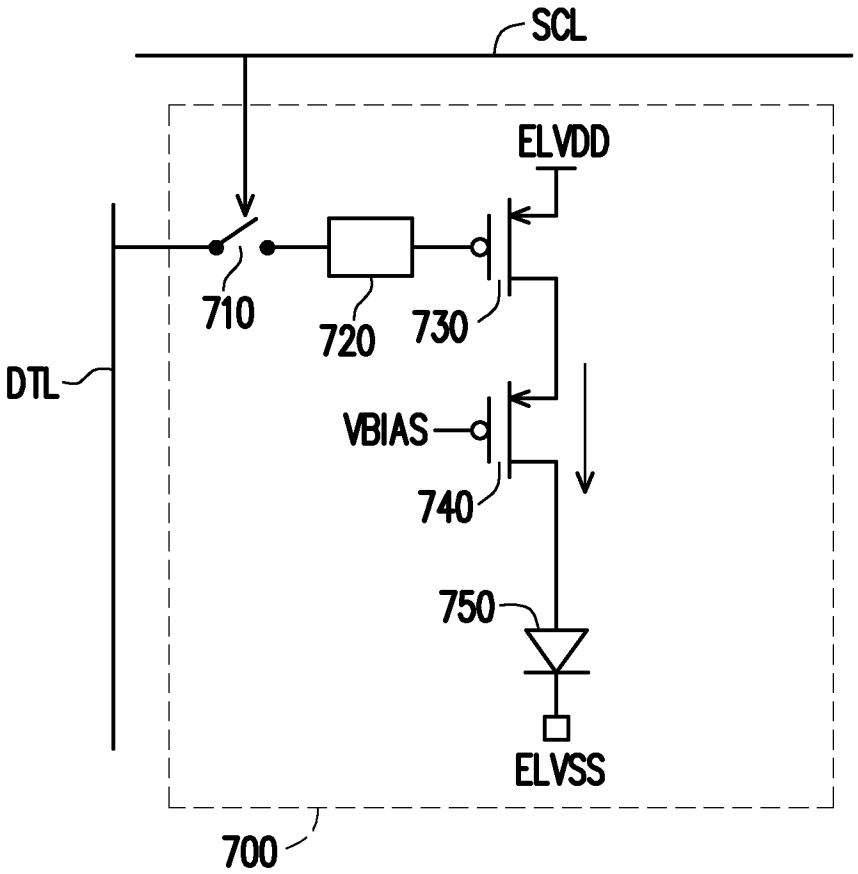
FIG. 7 is a circuit block diagram of a target pixel circuit in the display panel according to an embodiment of the disclosure.

FIG. 7 is a circuit block diagram of a target pixel circuit 700 in the display panel 220 according to an embodiment of the disclosure. The target pixel circuit 700 shown in FIG. 7 includes a switch 710, a data latch 720, a switch 730, a transistor 740, and a light-emitting element 750. Depending on the actual design, the light-emitting element 750 may include a light-emitting diode (LED), a micro-LED (μLED), an organic LED (OLED), or other light-emitting elements.

A first terminal of the switch 710 is coupled to the output terminal of the data driving circuit 212 of the driving device 210 through a corresponding data line DTL of the display panel 220. A second terminal of the switch 710 is coupled to an input terminal of the data latch 720. A control terminal of the switch 710 is coupled to the driving device 210 through a corresponding scan line SCL of the display panel 220. When the timing control circuit 211 performs scanning to the scan line SCL, the switch 710 is turned on, and the timing control circuit 211 may transmit a current bit (logic "1" or logic "0") in target pixel data corresponding to the target pixel circuit 700 through the data driving circuit 212, the corresponding data line DTL, and the switch 710 to the data latch 720.

An output terminal of the data latch 720 is coupled to a control terminal of the switch 730. The data latch 720 may be a single-bit latch. The data latch 720 may latch a current bit in the target pixel data and output the latched current bit to the control terminal of the switch 730. A first terminal of the switch 730 is coupled to a first voltage (e.g., a power voltage ELVDD). A first terminal of the transistor 740 is coupled to a second terminal of the switch 730. A control terminal of the transistor 740 is coupled to a bias voltage VBIAS. The level of the bias voltage VBIAS may be determined depending on the actual design. A first terminal of the light-emitting element 750 is coupled to a second terminal of the transistor 740. A second terminal of the light-emitting element 750 is coupled to a second voltage (e.g., a reference voltage ELVSS).

When the current bit latched by the data latch 720 is in a first logic state, since the switch 730 is turned on, the light-emitting element 750 may be lit up during the corresponding sub-frame period of the current bit. After the light-emitting element 750 is lit up, the light-emitting element 750 remains lit up over the current sub-frame period until the next sub-frame period. When the current bit latched by the data latch 720 is in a second logic state, since the switch 730 is turned off, the light-emitting element 750 may be unlit during the corresponding sub-frame period of the current bit. After the light-emitting element 750 is determined not to be lit up, the light-emitting element 750 remains unlit over the current sub-frame period until the next sub-frame period.

Figure 8:
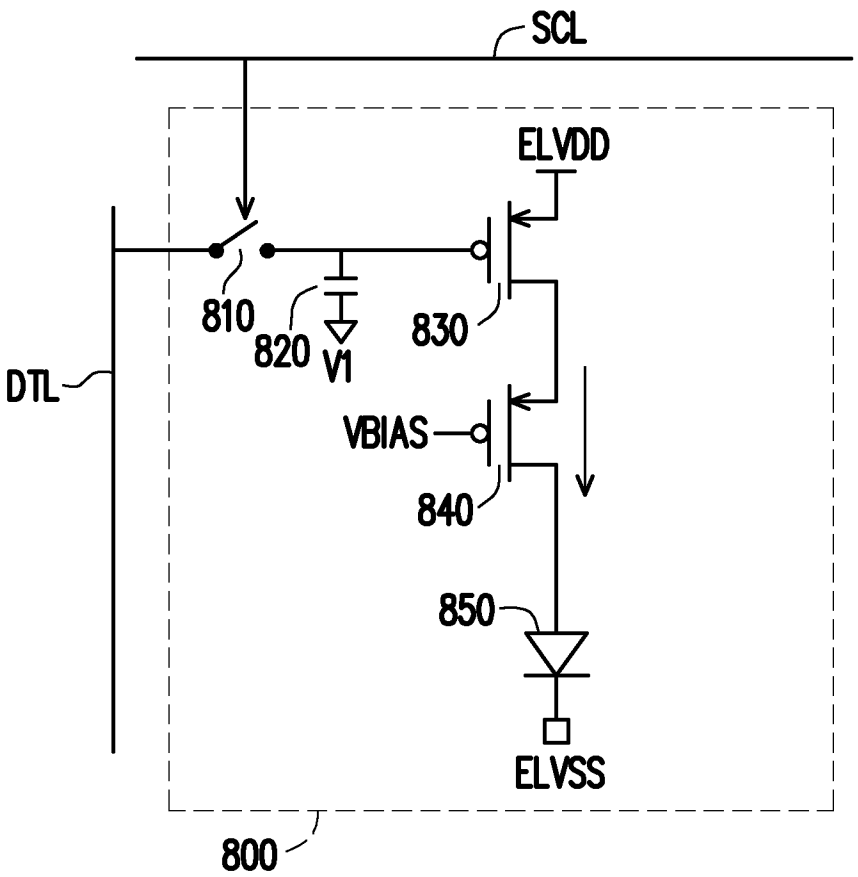
FIG. 8 is a circuit block diagram of a target pixel circuit in the display panel according to another embodiment of the disclosure.

FIG. 8 is a circuit block diagram of a target pixel circuit 800 in the display panel 220 according to another embodiment of the disclosure. The target pixel circuit 800 shown in FIG. 8 includes a switch 810, a capacitor 820, a switch 830, a transistor 840, and a light-emitting element 850. For the corresponding data line DTL, the corresponding scan line SCL, the switch 810, the switch 830, the transistor 840, and the light-emitting element 850 shown in FIG. 8, reference may be made to the relevant descriptions of the switch 710, the switch 730, the transistor 740, and the light-emitting element 750 shown in FIG. 7, which will not be repeated here. In the embodiment shown in FIG. 8, a first terminal of the capacitor 820 is coupled to a second terminal of the switch 810 and a control terminal of the switch 830. A second terminal of the capacitor 820 is coupled to a voltage VI (e.g., a ground voltage or other reference voltages).

When the timing control circuit 211 performs scanning to the scan line SCL, the switch 810 is turned on, and the timing control circuit 211 may transmit a current bit (logic "1" or logic "0") in target pixel data corresponding to the target pixel circuit 800 through the data driving circuit 212, the corresponding data line DTL, and the switch 810 to the capacitor 820. When the current bit stored in the capacitor 820 is in a first logic state, since the switch 830 is turned on, the light-emitting element 850 may be lit up during the corresponding sub-frame period of the current bit. After the light-emitting element 850 is lit up, the light-emitting element 850 remains lit up over the current sub-frame period until the next sub-frame period. When the current bit stored in the capacitor 820 is in a second logic state, since the switch 830 is turned off, the light-emitting element 850 may be unlit during the corresponding sub-frame period of the current bit. After the light-emitting element 850 is determined not to be lit up, the light-emitting element 850 remains unlit over the current sub-frame period until the next sub-frame period.

In summary of the foregoing, the driving device 210 according to the above embodiments may divide the image frame period FRAME2 into the plurality of sub-frame periods SF1 to SFm. Different bits in the same pixel data correspond to different sub-frame periods in the same image frame period. According to a current bit in the target pixel data corresponding to the target pixel circuit, the driving device 210 may determine whether to light up the target pixel circuit during the corresponding sub-frame period of the current bit.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A driving device configured to drive a display panel, comprising:

a data driving circuit, configured to be coupled to the display panel; and a timing control circuit, coupled to the data driving circuit, and configured to divide an image frame period into a plurality of sub-frame periods, wherein a target pixel circuit in the display panel corresponds to target pixel data comprising at least one bit, each bit in the target pixel data corresponds to at least one corresponding sub-frame period among the plurality of sub-frame periods, different bits in the target pixel data correspond to different sub-frame periods among the plurality of sub-frame periods, and according to a current bit in the target pixel data, the timing control circuit determines whether to light up the target pixel circuit through the data driving circuit during the at least one corresponding sub-frame period corresponding to the current bit.

2. The driving device according to claim 1, wherein the timing control circuit scans all scan lines of the display panel during each of the plurality of sub-frame periods.

3. The driving device according to claim 1, wherein time lengths of the plurality of sub-frame periods are not equal to each other, and the time length of each of the plurality of sub-frame periods corresponds to a bit position of a corresponding bit in the target pixel data.

4. The driving device according to claim 1, wherein a total time length of the at least one corresponding sub-frame period corresponding to the current bit corresponds to a bit position of the current bit.

5. The driving device according to claim 4, wherein time lengths of the plurality of sub-frame periods are equal to each other.

6. The driving device according to claim 1, wherein the timing control circuit determines to light up the target pixel circuit during the at least one corresponding sub-frame period corresponding to the current bit when the current bit is in a first logic state; and the timing control circuit determines not to light up the target pixel circuit during the at least one corresponding sub-frame period corresponding to the current bit when the current bit is in a second logic state.

7. An operation method of a driving device, comprising:

dividing an image frame period into a plurality of sub-frame periods, wherein the driving device is configured to drive a display panel, a target pixel circuit in the display panel corresponds to target pixel data comprising at least one bit, each bit in the target pixel data corresponds to at least one corresponding sub-frame period among the plurality of sub-frame periods, and different bits in the target pixel data correspond to different sub-frame periods among the plurality of sub-frame periods; and according to a current bit in the target pixel data, determining whether to light up the target pixel circuit during the at least one corresponding sub-frame period corresponding to the current bit.

8. The operation method according to claim 7, further comprising:

scanning all scan lines of the display panel during each of the plurality of sub-frame periods.

9. The operation method according to claim 7, wherein time lengths of the plurality of sub-frame periods are not equal to each other, and the time length of each of the plurality of sub-frame periods corresponds to a bit position of a corresponding bit in the target pixel data.

10. The operation method according to claim 7, wherein a total time length of the at least one corresponding sub-frame period corresponding to the current bit corresponds to a bit position of the current bit.

11. The operation method according to claim 10, wherein time lengths of the plurality of sub-frame periods are equal to each other.

12. The operation method according to claim 7, further comprising:

determining to light up the target pixel circuit during the at least one corresponding sub-frame period corresponding to the current bit when the current bit is in a first logic state; and determining not to light up the target pixel circuit during the at least one corresponding sub-frame period corresponding to the current bit when the current bit is in a second logic state.

13. A display apparatus, comprising:

a display panel; and a driving device, coupled to the display panel and configured to drive the display panel, wherein the driving device divides an image frame period into a plurality of sub-frame periods, a target pixel circuit in the display panel corresponds to target pixel data comprising at least one bit, each bit in the target pixel data corresponds to at least one corresponding sub-frame period among the plurality of sub-frame periods, different bits in the target pixel data correspond to different sub-frame periods among the plurality of sub-frame periods, and according to a current bit in the target pixel data, the driving device determines whether to light up the target pixel circuit during the at least one corresponding sub-frame period corresponding to the current bit.

14. The display apparatus according to claim 13, wherein the driving device comprises:

a data driving circuit, coupled to the display panel; and a timing control circuit, coupled to the data driving circuit, and configured to determine whether to light up the target pixel circuit through the data driving circuit during the at least one corresponding sub-frame period corresponding to the current bit according to the current bit.

15. The display apparatus according to claim 14, wherein the timing control circuit scans all scan lines of the display panel during each of the plurality of sub-frame periods.

16. The display apparatus according to claim 14, wherein time lengths of the plurality of sub-frame periods are not equal to each other, and the time length of each of the plurality of sub-frame periods corresponds to a bit position of a corresponding bit in the target pixel data.

17. The display apparatus according to claim 14, wherein a total time length of the at least one corresponding sub-frame period corresponding to the current bit corresponds to a bit position of the current bit.

18. The display apparatus according to claim 17, wherein time lengths of the plurality of sub-frame periods are equal to each other.

19. The display apparatus according to claim 14, wherein the timing control circuit determines to light up the target pixel circuit during the at least one corresponding sub-frame period corresponding to the current bit when the current bit is in a first logic state; and the timing control circuit determines not to light up the target pixel circuit during the at least one corresponding sub-frame period corresponding to the current bit when the current bit is in a second logic state.

20. The display apparatus according to claim 13, wherein the target pixel circuit comprises:

a first switch, having a first terminal coupled to the driving device through a corresponding data line of the display panel;

a data latch, having an input terminal coupled to a second terminal of the first switch, and configured to latch the current bit;

a second switch, having a control terminal coupled to an output terminal of the data latch, wherein a first terminal of the second switch is coupled to a first voltage;

a transistor, having a first terminal coupled to a second terminal of the second switch, wherein a control terminal of the transistor is coupled to a bias voltage; and a light-emitting element, having a first terminal coupled to a second terminal of the transistor, wherein a second terminal of the light-emitting element is coupled to a second voltage.

21. The display apparatus according to claim 13, wherein the target pixel circuit comprises:

a first switch, having a first terminal coupled to the driving device through a corresponding data line of the display panel;

a capacitor, having a first terminal coupled to a second terminal of the first switch, wherein a second terminal of the capacitor is coupled to a first voltage;

a second switch, having a control terminal coupled to the first terminal of the capacitor, wherein a first terminal of the second switch is coupled to a second voltage;

a transistor, having a first terminal coupled to a second terminal of the second switch, wherein a control terminal of the transistor is coupled to a bias voltage; and a light-emitting element, having a first terminal coupled to a second terminal of the transistor, wherein a second terminal of the light-emitting element is coupled to a third voltage.

* * * * *